United States Patent [19]

Ilk

[11] Patent Number: 4,681,236

[45] Date of Patent: Jul. 21, 1987

[54] DRINKING GLASS HAVING A PRESS-MOLDED STEM AND A BASE (OR PEDESTAL)

[76] Inventor: Emil Ilk, Industriezeile 24, A-5280 Braunau am Inn, Austria

[21] Appl. No.: 790,273

[22] Filed: Oct. 22, 1985

[51] Int. Cl.[4] ..... A47G 19/22; C03B 11/00

[52] U.S. Cl. ..... 215/99.5; 215/100 R; 206/459; 65/DIG. 10

[58] Field of Search ..... 215/99.5, 100 R; 65/DIG. 10, 85, 70; D7/11-13; 206/459

[56] References Cited

U.S. PATENT DOCUMENTS

| | | | |
|---|---|---|---|
| D. 77,227 | 12/1928 | Dougherty | D7/13 |
| D. 77,942 | 3/1929 | Dougherty | D7/13 |
| 143,778 | 10/1873 | Oesterling | 215/99.5 |
| 2,196,450 | 4/1940 | Forgaard | 215/99.5 X |
| 2,203,647 | 6/1940 | Cunningham et al. | 215/99.5 |

FOREIGN PATENT DOCUMENTS

| | | | |
|---|---|---|---|
| 2632125 | 8/1977 | Fed. Rep. of Germany | 65/DIG. 10 |
| 1083176 | 9/1967 | United Kingdom | 215/99.5 |

*Primary Examiner*—William Price
*Assistant Examiner*—Sue A. Weaver
*Attorney, Agent, or Firm*—Fitch, Even, Tabin & Flannery

[57] ABSTRACT

A drinking glass having a press-molded stem and a base (or pedestal), comprising at least one hollow passage extending approximately horizontally and transversely through the stem. An insert, formed of, for example, a colored plastic, may be fitted into the hollow passage.

5 Claims, 6 Drawing Figures

DRINKING GLASS HAVING A PRESS-MOLDED STEM AND A BASE (OR PEDESTAL)

Figure 1:
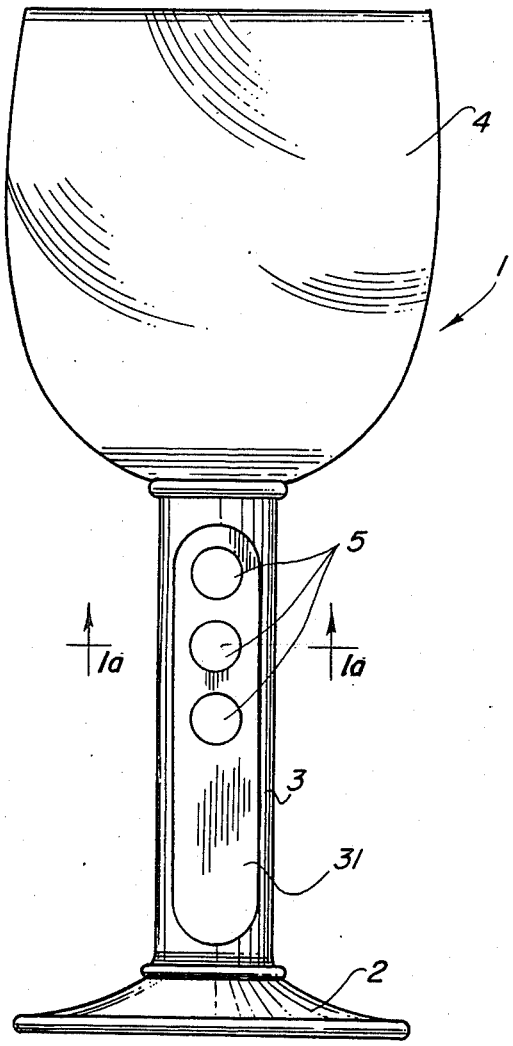

The present invention relates to a drinking glass having a press-molded stem and a (standing) base or pedestal.

Normal drinking glasses of this type comprise a solid stem, with the stem generally constituting the part of the glass having the maximum material thickness.

A drawback of drinking glasses of this type having a solid stem is that considerable stress is produced within the stem during the cooling phase in production. In order to reduce this stress which results in a increased risk of breakage, the glasses must be reheated to a temperature of a multiple of 100° C. subsequently, and cooled down in accordance with a fixed time-temperature schedule. This additionally required step of production is both energy- and time-consuming and results in high production costs.

Now, it is the object of the invention to provide a drinking glass of the type as outlined above, which avoids the abovementioned drawbacks and which particularly shows lower (mechanical) stress in its stem, so that it may be produced at lower cost and is less liable to break.

The solution of this object is achieved by a drinking glass of the above-outlined type, having at least one hollow passage passing substantially horizontally and transverse through the stem. Preferably, a plurality of passages are provided in the stem one above the other. By this structure, cooling of the glass stem in the course of production of the glass is improved considerably, because the distance across which the heat stored in the stem immediately after the forming thereof must flow is substantially shorter. Namely, aside from the outer side of the stem, dissipation of heat takes place also from the surfaces of the hollow passages. Although cooling of the stem takes place faster, it also takes place more uniformly, and this, as a result, means a noticeable reduction of the remaining (mechanical) stress. In this manner, a glass stem is obtained which is more stable (of higher strength) than a conventional solid stem in spite of the hollow passages provided therein. Another advantage that results resides in the special aesthetical effect which accompanies the stem according to the invention.

Particularly advantageous cross-sectional shapes of the hollow passages are a circular shape and an oval shape. When using the firstmentioned (circular) cross-sectional shape, expediently a plurality of passages are provided in the stem one above the other, since the surface area of a passage of such a shape is relatively small. When using the second preferred (oval) shape the surface area of which is larger, depending on the height of the stem there are expediently provided only one or two hollow passages in the stem, with the long axis of the oval shape extending, conveniently, in the longitudinal direction of the stem.

Another advantageous embodiment of the drinking glass according to the present invention resides in the fact that at least one insert is fitted into the hollow passage. This insert has the function of both increasing the strength and grip of the glass stem, and permitting to differentiate between individual drinking glasses of otherwise identical configuration. This feature is of particular advantage in, for example, using the glasses according to the invention at parties or on other occasions where a fixed seating plan does not exist and where the drinking glasses were heretofore liable to be mixed up. The fact that several persons may drink from the same glass, not only is unpleasant, but in worst case even might endanger the health by the transfer and spreading of germs. Such an event is effectively prevented from occuring by the definite marking of the drinking glasses according to the invention, whereby they may be easily recognized. Of special advantage is the fact that the above-mentioned inserts constitute a really permanent marking which does not disappear in the course of time owing to frequent use and cleaning of the drinking glasses. Nevertheless, the special appearance of a drinking glass series of unified style and shape is fully preserved.

According to preferred embodiment of the drinking glass, the inserts are formed of a colored plastic. In such a case, each insert may have either a single color or several colors, and a plurality of inserts of the same color or of different colors may be positioned within the hollow passages of a stem. The inserts may be formed as a single piece and fitted into the passages with a press fit; alternatively, they may be of a two-piece structure and fitted into a passage from either end thereof, so as to fill out at least part of the length of the passage. Still further, the front ends of the two inserts parts meeting each other interiorly of the hollow passage, may be connected to each other by adhesive, clips or in any other manner.

Figure 3:
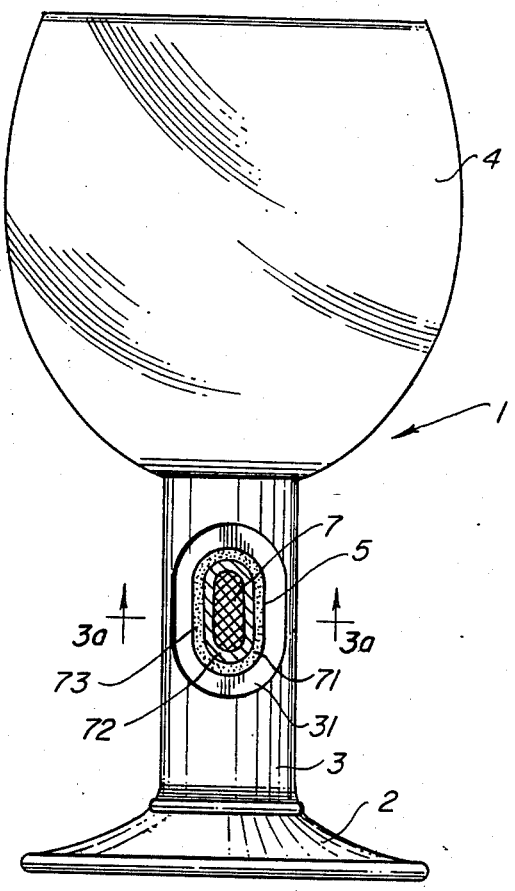
Figure 1A:
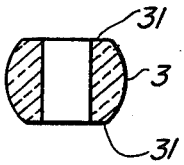
Figure 3A:
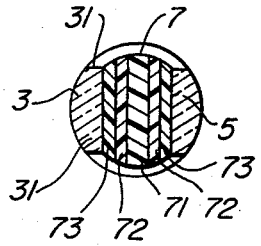
Figure 2:
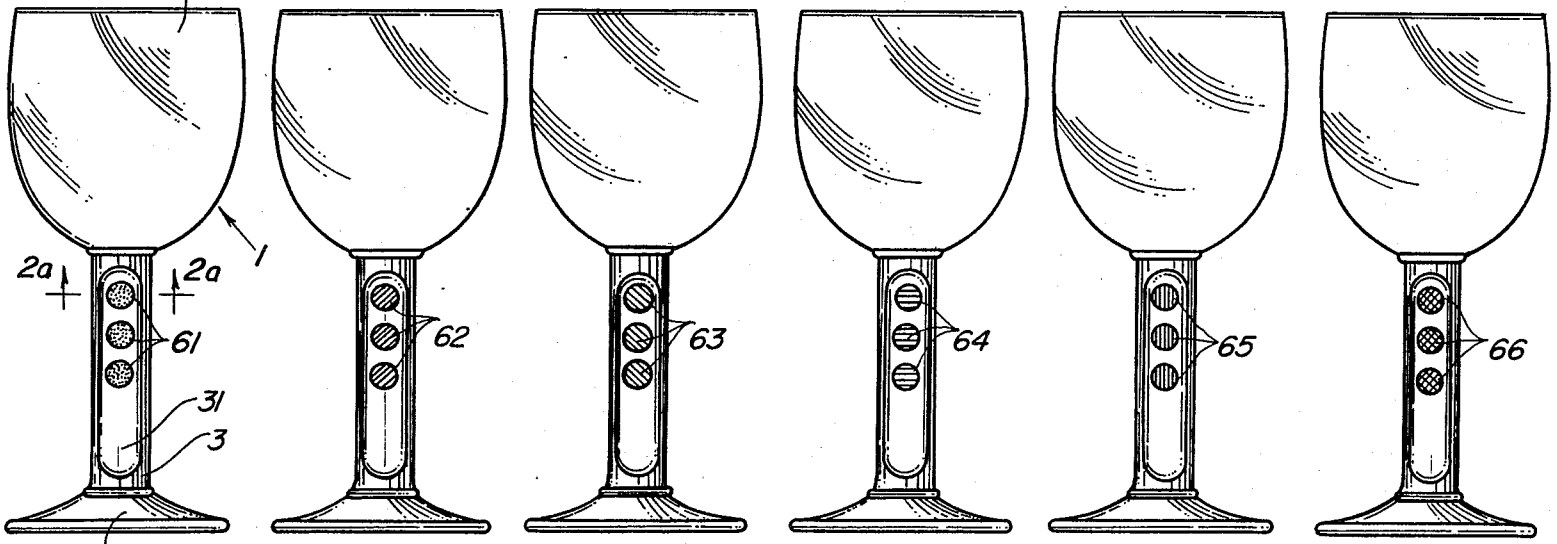
Figure 2A:
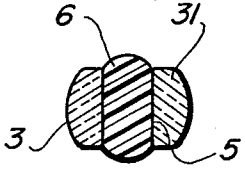

Below, a preferred embodiment of the invention is explained in greater detail with reference to a drawing, wherein:

FIG. 1 is a front elevational view of a drinking glass according to the invention;

FIG. 1*a* is a view in section taken along lines A—A of FIG. 1;

FIG. 2 shows a series of glasses comprising six drinking glasses according to the invention;

FIG. 2*a* is (enlarged) view in section along lines A—A of the first glass of the drinking glass series of FIG. 2;

FIG. 3 is a front elevational view of an alternate embodiment of a drinking glass according to the invention; and FIG. 3*a* is a view in section along lines B—B through the drinking glass of FIG. 3.

As shown in FIG. 1, the drinking glass according to the invention comprises, like conventional drinking glasses, a foot or base 2, a stem 3 and a glass bowl 4 to receive the drink. In the exemplary embodiment shown, hollow passages 5 are provided which pass approximately horizontally through the stem 3. In this embodiment, the hollow passages 5 have a circular cross-section. Instead of three hollow passages 5, a greater or smaller number of hollow passages 5 may be provided in the stem 3.

As appears particularly from the sectional view of FIG. 1*a*, being a section along lines A—A through the stem 3 of the drinking glass 1 of FIG. 1, the distances from the interior of the glass mass (material) to a free surface are considerably reduced as compared to a solid stem, whereby the above-described advantages with respect to cooling of the stem 3 in the production thereof are obtained.

Another essential advantage achieved by the invention appears from FIG. 2. This Figure illustrates a series of glasses comprising six drinking glasses 1 of identical shape and style, with each glass having in its stem 3 three hollow passages 5 of a circular cross-section, which passages are positioned one above the other and pass transversely through the stem. Correspondingly formed (complementary) inserts 6 are fitted into the hollow passages 5, which inserts in the embodiment of the series of glasses as shown, are of the same color in one glass stem 3, but of different colors 61 to 66 among the glass stems of the series. By virtue of these colored inserts 6, each glass 1 of the series can be distinguished from the other glasses 1 without impairing the special character of a series of glasses.

FIG. 2*a* shows a view in section along lines A—A through the stem 3 of the first glass 1 of the series of drinking glasses shown in FIG. 2. In the embodiment shown, the insert 6 fitted into the hollow passage 5 comprises an integral (one-piece) cylindrical body the ends of which are mounted lenticularly and protrude slightly over the flat faces 31 of the stem 3. This structure improves especially the grip of the stem 3.

Another preferred embodiment of the drinking glass according to the invention is shown in FIG. 3. This drinking glass, too, comprises a base 2, a stem 3 and a glass cup 4. The stem 3 of this glass 1 is likewise provided with a flat face 31 in which a hollow passage 5 extends through the stem 3 transversely. In this embodiment, however, the hollow passage 5 has an oval cross-section, with the long axis of the oval extending in the direction of the longitudinal axis of the stem 3. Fitted into this hollow passage 5 is a suitable insert 7, preferably formed of plastic. Shown as an example is an insert 7 having three regions of different colors 71 to 73 the boundaries of which extend in parallel with the outline of the hollow passage 5. In this instance the insert 7 may be either integral or formed of a plurality of component parts of different colors.

Finally, FIG. 3*a* illustrates the stem 3 of the drinking glass 1 according to FIG. 3 in section along lines B—B. In this embodiment, the insert 7 likewise has its end protruding over the flat faces 31 on the stem 3, thereby defining a curved portion which both constitutes an appealing design and improves the grip of the stem 3 when the drinking glass 1 is grasped and raised. In this case, too, the differently colored portions 71 to 73 of the insert 7 are clearly recognizable.

I claim:

1. A drinking glass comprising:

a bowl;

a base;

a press-molded stem intermediate the bowl and the base and integrally formed therewith, and having a maximum thickness substantially greater than a maximum thickness of the bowl and of the base; and said stem including means defining at least one stress-relieving passageway extending therethrough in a generally transverse, horizontal direction.

2. The drinking glass of claim 1, wherein said means further comprises a plurality of said stress-relieving passageways, located one above the other, each approximately centered on an axial centerline of said stem, and each extending through said stem in a generally transverse, horizontal direction.

3. The drinking glass of claim 1 wherein said means further comprises an insert formed of plastic material and fitted in said passageway so as to engage and strengthen said stem.

4. The drinking glass of claim 3 wherein said insert is made of one of a plurality of different colored plastic materials so as to provide identifying indicia for the drinking glass.

5. The drinking glass of claim 2 wherein said means further comprises a plurality of plastic inserts, one in each of said passageways, said plastic inserts formed from at least one of a plurality of different colored plastic materials, so as to provide identifying indicia for the drinking glass.

* * * * *